United States Patent [19]

Corlett

[11] 4,084,534

[45] Apr. 18, 1978

[54] ROLL DAMPING TANKS FOR SHIPS AND LIKE VEHICLES

[75] Inventor: Ewan Christian Brew Corlett, Basingstoke, England

[73] Assignee: Hydroconic Limited, Ramsey, Isle of Man

[21] Appl. No.: 700,844

[22] Filed: Jun. 29, 1976

Related U.S. Application Data

[63] Continuation-in-part of Ser. No. 564,122, Apr. 1, 1975, abandoned.

[30] Foreign Application Priority Data

May 28, 1974 United Kingdom ..... 23689/74

[51] Int. Cl.[2] ..... B63B 39/03

[52] U.S. Cl. ..... 114/125

[58] Field of Search ..... 114/74 T, 74 R, 121, 114/125

[56] References Cited

U.S. PATENT DOCUMENTS

| | | | |
|---|---|---|---|
| 970,368 | 9/1910 | Frahm | 114/125 |
| 2,716,958 | 9/1955 | Brandon | 114/74 R |
| 3,322,090 | 5/1967 | Pangalila | 114/125 |

FOREIGN PATENT DOCUMENTS

| | | | |
|---|---|---|---|
| 1,039,700 | 8/1966 | United Kingdom | 114/125 |

*Primary Examiner*—Stephen G. Kunin
*Assistant Examiner*—Stuart M. Goldstein
*Attorney, Agent, or Firm*—Rose & Edell

[57] ABSTRACT

A roll-damping tank for ships to extend athwartships and to contain liquid that moves in the direction from end to end of the tank as the ship rolls, in which the ends of the tank at the sides of the ship are configured by curving or chamfering to destroy the velocity of the wave in the tank.

4 Claims, 6 Drawing Figures

ROLL DAMPING TANKS FOR SHIPS AND LIKE VEHICLES

RELATED APPLICATION

Figure 1:
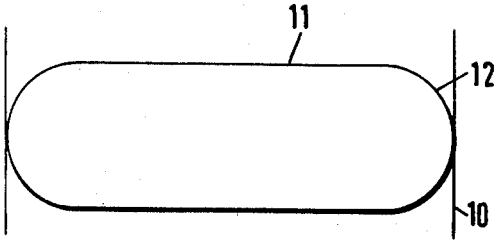

This application is a continuation-in-part of my prior application for U.S. Pat. Ser. No. 564,122, filed Apr. 1, 1975, now abandoned.

BACKGROUND OF THE INVENTION

This invention relates to roll-damping tanks.

Open topped water tanks running across ships have been used for approximately 100 years for the damping out of rolling motions. These fundamentally consist of a rectangular tank running athwartships, spaced above the roll centre if possible, and containing water to approximately one-third of their depth, and such tanks damp out roll by the water in them oscillating to and fro in antiphase to the movement of the ship. The velocity of the water in the tank across the ship is determined by its depth and hence for a given period of roll of the ship the period of oscillation in the water in the tank can be adjusted to match. This has been well known for a hundred years and is a long-established state of the art.

The introduction of constrictions in the tank is common. Indeed restrictions were introduced in quite early tanks, the idea being that the energy absorbed by such restrictions as the water flowed over or round them in a turbulent manner would increase the damping of the ship. This is a fallacy. Any restrictions tend to restrict the roll damping moment available compared with the free transfer of water across the ship, and from this narrow point of view they are disadvantageous.

However, it is essential that the phase angle of the roll damping moment be correct in relation to the roll of the ship and it is found in some cases, especially for example with ships with long rolling periods, that the correct phase relationship is very difficult to obtain with a simple tank without constrictions because there is not enough damping in the tank to prevent secondary oscillations of the water induced by the efffect of the ship on the tank water. Hence the major purpose for introducing constrictions in tanks is to adjust the phase angle, and the secondary purpose is to prevent excitation of the tank by the ship in such a manner at very low and very high frequencies that the roll is actually increased. By destroying the velocity of the wave in the tank this phase angle can be modified and the product of stabilising moment and phase angle can be increased even though the stabilising moment itself is decreased.

The present invention relates to means of effecting this by choice of the shape of the tank rather than by way of actual restriction to flow.

In plan view such a tank is normally rectangular, and narrower in the fore and aft direction of the ship than in the transverse direction, in which latter direction the tank generally, if possible, extends the full breadth of the ship. As already stated, the water is usually approximately one-third the depth of the tank.

SUMMARY OF THE INVENTION

According to the invention, there is provided, in a ship, a roll-damping tank to contain liquid that moves in the direction from end to end of the tank upon occurrence of the roll to be damped, said tank having a generally rectangular cross-section and ends that are contiguous with the ship's hull side walls, and wherein the tank walls are configured so that in plan the tank appears as having straight sides and continuously curved ends to which the ship's sides are tangential, and in elevation the tank appears as being generally rectangular with ends that reduce in cross-section, the upper end corners forming right angles with the top of the tank and the tank bottom having end portions that ascend progressively as the extreme ends of the tank are approached to produce said reduction in cross-section.

In one form, each end of the tank is, in plan, a semicircle, with the sides of the tank and the ship's side both tangential thereto.

In another form, these curves are not circular but are transition curves, for example cubic parabolae.

In elevation looking from the bow or stern of the ship towards the forward side wall or after side wall of the tank, the tank is again rectangular in normal form but as now proposed the ends are curved upwards from the floor of the tank to meet the ship's side or tank end wall or alternatively the curve may extend right to the top of the tank. This curve again may be a radius, it may be a cubic parabola, or even may be a flat chamfer, in each case running from the bottom of the tank to the ship's side or going right to the top of the tank at the ship's side.

With this arrangement, the wave in the tank is turned over upon itself and two objects are achieved; the first a considerable dissipation of the energy, and the second a protection of the ends and the top of the tank from impact.

The action of the end that is curved in plan is effective in destroying the velocity of the wave in the tank. In plan view it can be seen that as a wave or bore proceeds from one outboard end of the tank to the other, and/when it meets the curved end of the tank, its own ends, fore and aft of the ship, are increased in height and in velocity by the constriction to the flow presented by that curved end. Hence the wave front tends to become curved with higher ends, this process continuing until eventually the two ends of the wave meet on the centreline. This meeting destroys by impact a considerable amount of energy in the wave and this energy has to be imparted again to the wave by the ship's motion. it can be seen, therefore, that in the process of imparting this energy there must be a time lag and hence the phase of the wave is affected relatively to that of the ship.

Where the bottom of the tank is curved or chamfered upwards at the ship's side a similar effect exists. The wave is accelerated and lifted up and tends to impact the top of the tank. Where the ends are curved in plan view as well as in elevation it can be seen that a very concentrated meeting of the three wave motions is effected and considerable destruction of energy results.

In a further form, when the ends are chamfered or curved upwards from the bottom to the ship's side or to the top of the tank, a horizontal plate may be fixed below the deck head at the top of the tank at each end (that is to say at the ship's side). This plate can be perforated and used to destroy the impact of the wave, thus protecting the structure above, and further removing energy from the wave itself. Slatted bars, variously apertured plates and/or other means can be used for achieving this end.

Overall this system offers a very efficient means of reducing the energy in a wave or bore, particularly in the case of a bore where considerable movement of liquid is involved. This removal of energy affects the phase of the bore or wave relative to the ship and thus achieves the same result as constrictions or other obstructions in the tank proper.

DETAILED DISCLOSURE

Figure 2:
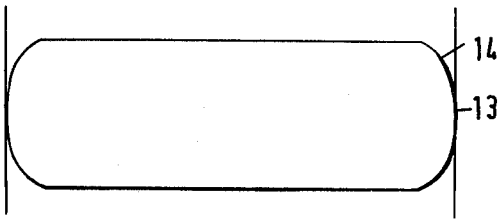

Arrangements according to the invention are shown by way of example in the accompanying drawings, in which:

FIGS. 1 and 2 show two different forms of roll damping tank in plan, and FIGS. 3 to 6 show four forms in elevation looking toward the tank along the longitudinal axis of the ship.

FIG. 1 shows a roll damping tank 11 in which the ends 12 are semi-circular in plan, the ship's sides 10 being tangential thereto. In FIG. 2 the curves 14 of the tank ends 13 are substantially parabolic, e.g. cubic parabolae, the ship's sides again being tangential thereto. Other forms of continuous transition curve are also possible.

Figure 3:
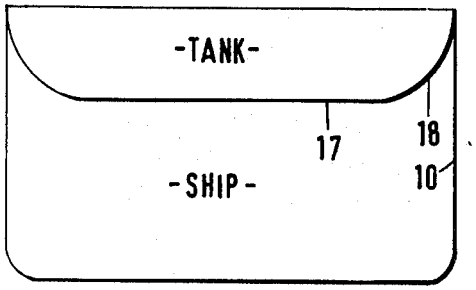
Figure 4:
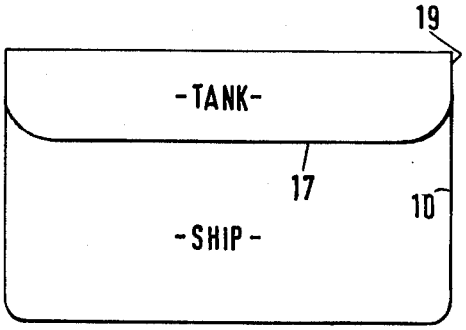
Figure 5:
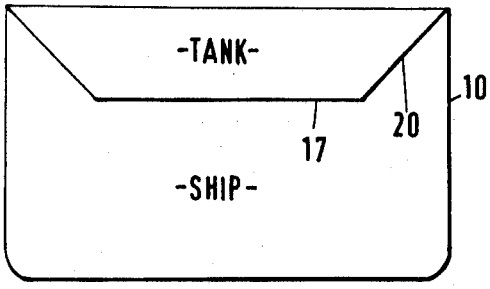

FIG. 3 shows in elevation a tank 17 in which the ends 18 are each curved in a quarter circle with the ship's side wall 10 tangential thereto and the curve extending right up to the top of the tank. In FIG. 4 the curves are of smaller radius so that there is a flat 19 at each end of the tank. In each case the curves need not be circular but can be some other form of transition curve. Alternatively, the curves can be replaced by flat chamfer faces as in FIG. 5, in which the chamfer faces 20 extend to the top of the tank, or FIG. 6, in which the chamfer faces 21 are shorter and the tank has vertical ends flats 22.

Figure 6:
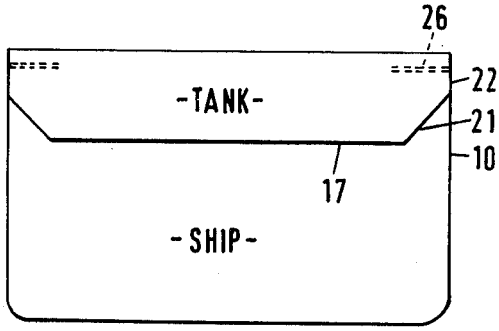

In addition to the end chamfers, the tank of FIG. 6 also has a horizontal apertured plated 26 extending in from each end wall near the top of the tank, to destroy the wave impact as already discussed.

What I claim is:

1. In a ship, a roll-damping tank to contain liquid that moves in the direction from end to end of the tank upon occurrence of the roll to be damped, said tank having a generally rectangular cross-section and ends that are contiguous with the ship's hull side walls, and wherein the tank walls are configured so that in plan the tank appears as having straight sides and continuously curved ends to which the ship's sides are tangential, the curved ends being such that consecutive points on the curved ends have tangents at different angles, and in elevation the tank appears as being generally rectangular with ends that reduce in cross-section, the upper end corners forming right angles with the top of the tank and the tank bottom having end portions that ascend progressively as the extreme ends of the tank are approached to produce said reduction in cross-section.

2. A ship's roll-damping tank according to claim 1, wherein as seen in elevation the tank has substantially quarter-circle ends extending from the bottom to the top of the tank and to which both the tank bottom and the ship's side walls are tangential.

3. A roll-damping tank according to claim 1, wherein as seen in elevation the tank ends have chamfered bottom corners extending to end flats.

4. A roll-damping tank according to claim 3, wherein apertured plates are provided internally of and extending horizontally in from the tank ends near the top of the tank.

* * * * *